United States Patent [19]

Pas

[11] Patent Number: 4,551,943

[45] Date of Patent: Nov. 12, 1985

[54] FLOWER MERCHANDISING DISPLAY

[76] Inventor: Rene J. T. M. Pas, Kapellenberglaan 44, Rozendaal, Netherlands

[21] Appl. No.: 635,663

[22] Filed: Jul. 30, 1984

[51] Int. Cl.[4] ..... A01G 7/00

[52] U.S. Cl. ..... 47/41 R; 62/376; 47/39

[58] Field of Search ..... 47/41, DIG. 2, 39, 79, 47/41.1, 41.11, 41.12, 41.13, 17, 1.1; 312/236; 165/104.31, 132, 133; 62/376

[56] References Cited

U.S. PATENT DOCUMENTS

| | | | |
|---|---|---|---|
| 986,875 | 3/1911 | Tilghman | 47/39 |
| 1,235,056 | 7/1917 | Renner | 312/236 |
| 2,004,691 | 6/1935 | Friedrich | 47/DIG. 2 |
| 2,081,048 | 5/1937 | Bates | 47/41 |
| 3,696,630 | 10/1972 | Bressickello | 62/376 |
| 4,027,327 | 6/1977 | Pullens | 312/236 |
| 4,108,373 | 8/1978 | Chiapale et al. | 47/17 |

*Primary Examiner*—Robert E. Bagwill
*Assistant Examiner*—Bradley M. Lewis
*Attorney, Agent, or Firm*—Rodgers & Rodgers

[57] ABSTRACT

A flower merchandising display comprising three containers arranged in a vertically stacked arrangement, pump and cooling means disposed in the lower container, water contained in the middle container, flowers disposed in the upper container, and means extending upwardly from the middle container and being adapted to cool the air contained therein and allow it to fall downwardly therefrom and then upwardly around the flowers.

15 Claims, 5 Drawing Figures

FLOWER MERCHANDISING DISPLAY

TECHNICAL FIELD

This invention relates to means for maintaining flowers disposed in a merchanding display at the proper temperature to aid in preservation of the flowers while at the same time not requiring any artificial means for providing air flow.

BACKGROUND ART

Known means for cooling flowers and maintaining the temperature of the air surrounding the flowers at a desired level generally involves large enclosed refrigerated displays. Normally the flowers are removed from these displays by the customer through bulky vertically disposed glass doors. In this type of arrangement it is necessary to provide not only cooling means but also artificial air flow means to force the cooled air around the flowers. Oftentimes condensation forms on the glass doors which, of course, inhibits product viewing.

By this invention, a merchandising display for flowers is provided which uses natural air flow for preserving the flowers at a constant temperature. At the same time it allows the flowers to be viewed by potential purchasers out in the open and at the optimum commercially desirable eyesight angle.

DISCLOSURE OF THE INVENTION

A flower merchandising display comprising a container having liquid contained therein, means to elevate at least a portion of the liquid above the container, means for allowing escape of the gas disposed naturally in the means to elevate the liquid, and the escape means formed in the lower portion of the means to elevate the liquid and being disposed above the liquid.

BEST MODE FOR CARRYING OUT THE INVENTION

Figure 1:
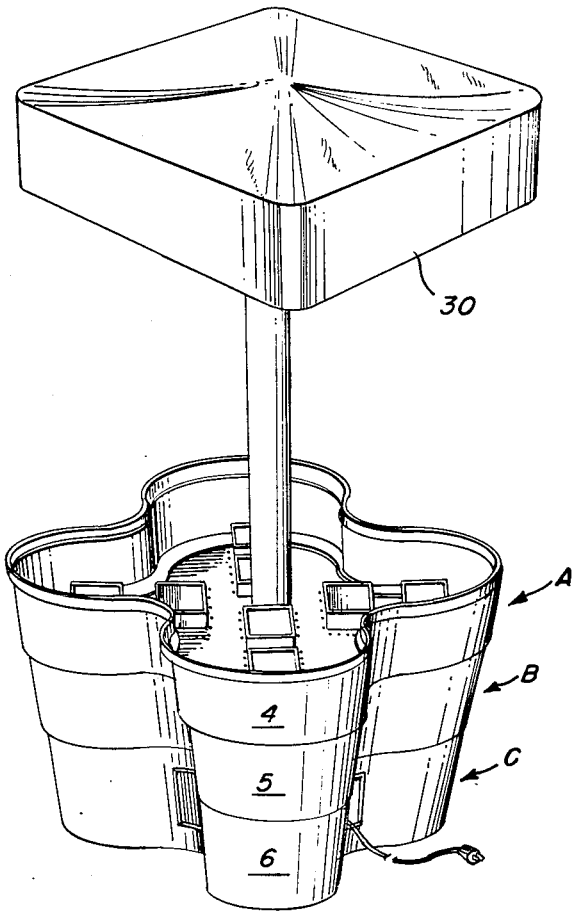
FIG. 1 is a perspective view of a flower merchandising display according to this invention.
Figure 2:
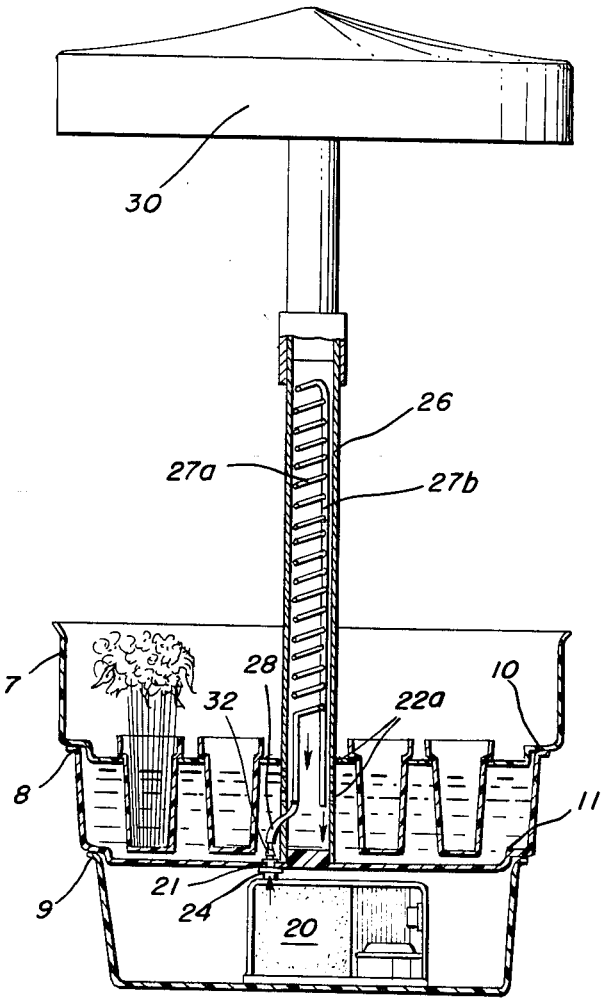
FIG. 2 is a side elevational view with a portion of the outer structure removed for purposes of clarity.

In the drawings, the numerals 1, 2 and 3 designate the bottoms respectively of upper container A, middle container B and lower container C constructed according to this invention. Integrally joined respectively to the outer edges of bottoms 1, 2 and 3 and extending upwardly therefrom are serpentine side walls 4, 5 and 6. Also integrally joined respectively to the upper edges of side walls 4, 5 and 6 are outwardly extending lip portions 7, 8 and 9 and formed along the lower edge portions of side walls 4 and 5 respectively are grooves 10 and 11. As best shown in FIG. 2, lips 8 and 9 are adapted to fit snugly respectively in grooves 10 and 11.

Formed in the bottom wall 3 of lower container C are multiple recessions 12. In similar fashion recession 13 is formed in bottom 2 of middle container B. Also apertures 14 and 15 are formed in bottom 2.

For the purpose of receiving flower pots, such as shown at 16, multiple flower pot receiving apertures 17 are formed in bottom wall 1 of upper container A. In addition conduit receiving aperture 18 is formed in bottom 1. For the purpose of enhancing the flow of air through the display, multiple air flow apertures 19 are formed in bottom 1 adjacent each side edge of flower pot receiving apertures 17.

According to this invention, means to elevate liquid is provided in the form of pump 20, cooling or refrigeration means 21 and enveloping means indicated generally by the numeral 22. More specifically, pump 20 and cooling means 21 are disposed on platform **22*c*. Although not shown in the drawings multiple rubber legs are attached to the underside of plate 22*c*. The rubber legs are adapted to fit into corresponding recessions 12 as is well known. Also provided in connection with pump 20 are threaded intake aperture 23 and threaded outlflow aperture 24. Formed in the side wall 6 are multiple airflow channels 25**.

With respect to enveloping means 22, more specifically, elongated conduit 26 is provided and disposed generally inside elongated conduit 26 in copper tubing 27 which has a generally spiral shaped portion **27*a* and an elongated linear portion 27*b*. Attached to the lowermost free end of spiral section 27*a* is flexible hose 28. In addition for purposes of stability, inner stem 29 is disposed generally inside and in abutting engagement with the inner edge portions of spiral section 27*a*. Also canopy 30 is fixed in overlapped telescoping relationship with the upper portion of enveloping means 22 as is best shown in FIG. 2**.

In order to set up the flower merchandising display according to this invention, initially it is necessary to place middle container B over pump 20 and cooling means 21 by precisely aligning apertures 14 and 15 with threaded water tight apertures 23 and 24 respectively. Following this threaded water tight fixtures 31 and 32 are screwed respectively into apertures 23 and 24. In addition fixture 32 is provided with nozzle **32*a*. Then the entire middle container B together with the pump 20 and cooling means 21 which are attached to the underside of container B is placed in lower container C by precisely aligning the rubber feet disposed on the underside surface of plate 22*c* into corresponding recessions 12 so that lip 9 slides into groove 11**. Although not shown, middle and lower containers B and C can be secured together by any suitable means such as nut and bolt assemblies, wing nuts and the like.

Then upper container A is placed on middle container B so that lip 8 fits snugly in groove 10. Next enveloping means 22 is slipped through aperture 18 and moved into abutting relationship with recession 13 in bottom 2. Following this the free end of flexible hose 28 is slipped over nozzle **32*a***. Then the middle container is filled with any suitable liquid such as water so that the upper level of the water is spaced about 1 cm from the underside of upper container A.

In operation, the water or other liquid contained in middle container B is drawn downwardly through aperture 14 by means of pump 20 and suitably cooled by cooling means 21 to a temperature of approximately 2 degrees C. and then pumped upwardly through aperture 15 through nozzle **32*a* and into flexible hose 28. The water then proceeds upwardly through spiral section 27*a* to the top thereof whereby it flows into elongated linear section 27b and then downwardly therethrough and ultimately flows out of tubing 27. The water then flows through slots 22b** and back into middle container B whereby it is appropriately recirculated.

According to this invention, by means of continually recirculating the cooled water through the display as discussed above, the air contained in elongated conduit 26 is effectively cooled which causes it to flow in a downwardly direction and build kinetic energy. Therefore the downwardly flowing air in effect is forced through apertures 22a into the space between the upper level of the water and the lower surface of upper container A. Since a constant over pressure occurs by means of the downward flow of the air in elongated conduit 26, the air is forced through apertures 22a and upwardly through apertures 19 whereby the cooled air envelops the flowers contained in flower pots 16. Also since the upper edge of the upper container is higher than the tops of the flowers, the flowers themselves are constantly maintained in a proper cooled state. Therefore by this invention a natural flow of cooled air is provided and which is not dependent on any artificial air flow assisting means.

Figure 3:
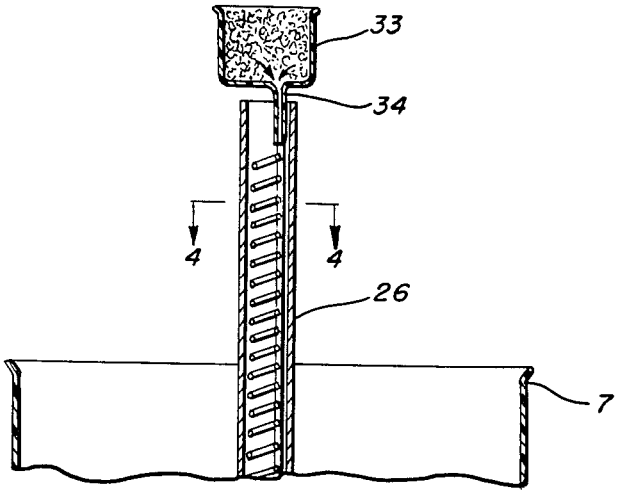
FIG. 3 is a partial side elevational view of the upper portion of a modified form of the invention with the outer structure removed.
Figure 4:
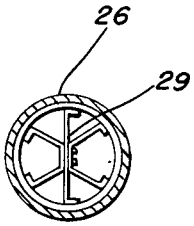
FIG. 4 is a top plan view taken along the line 4—4 in FIG. 3.
Figure 5:
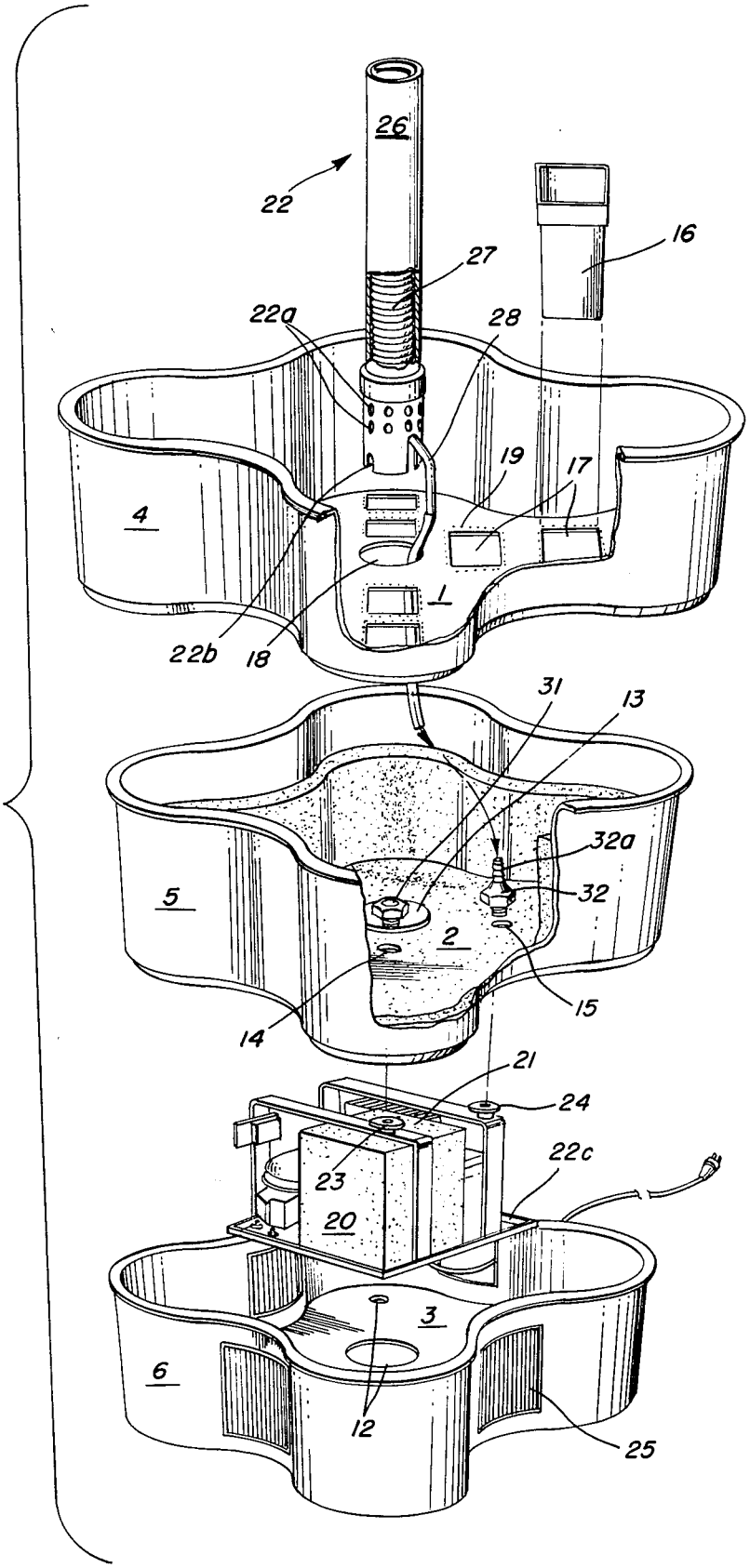
FIG. 5 is an enlarged exploded view of the flower merchandising display with the top canopy removed.

A modified form of the invention is shown in FIG. 3 by means of which container 33 is provided and is adapted to interconnect with the upper end of spiral section 27a by means of telescoping spout 34. Then flaked ice is simply placed in container 33 and as the ice melts the cold water flows through spiral section 27a to cool the air contained in elongated conduit 26 in basically the same manner as discussed above in connection with the operation of pump 20 and cooling means 21 and associated structure. Therefore by this means, the flower merchandising display can be utilized without the necessity of having an electrical connection.

INDUSTRIAL APPLICABILITY

By this invention, display means is provided for the merchandising of flowers which allows a constant flow of properly cooled air to envelope the flowers without the necessity of having artificially assisted air flow means.

I claim:

1. A flower merchandising display comprising a first container, liquid contained in said first container, means to elevate at least a portion of said liquid above the top of said first container, means to return said liquid downwardly to said first container, said means to elevate said liquid comprising enveloping means, said enveloping means extending above said liquid, gas contained in said enveloping means, said means to elevate and said means to return said liquid at least partially disposed in said enveloping means, and means for allowing escape of said gas from said enveloping means being formed in said enveloping means and disposed above the upper level of said liquid.

2. A flower merchandising display according to claim 1 wherein a second container is disposed above said first container and in abutting relationship therewith.

3. A flower merchandising display according to claim 1 wherein a third container is disposed below said first container and is interconnected therewith.

4. A flower merchandising display according to claim 1 wherein said enveloping means comprises an elongated circuit.

5. A flower merchandising display according to claim 3 when said means to elevate said liquid comprises a pump disposed in said third container.

6. A flower merchandising display according to claim 5 wherein said means to elevate said liquid further comprises tubing disposed in said enveloping means and wherein said pump is in communication with said tubing.

7. A flower merchandising display according to claim 1 wherein said liquid comprises water.

8. A flower merchandising display according to claim 4 wherein said first container comprises a bottom and wherein the lower end of said elongated conduit is disposed in abutting engagement with said bottom and wherein the upper end of said elongated conduit is disposed substantially above said first container and wherein the lower portion of said elongated conduit is disposed in said liquid.

9. A flower merchandising display according to claim 6 wherein said tubing is adapted to deliver said fluid respectively to a point substantially adjacent the upper end of said enveloping means and then downwardly therefrom.

10. A flower merchandising display according to claim 9 wherein said tubing to deliver said liquid upwardly is of spiral configuration and wherein said tubing to deliver said liquid downwardly is substantially of an elongated linear configuration.

11. A flower merchandising display according to claim 2 wherein an aperture is formed in the lower portion of said second container and is adapted to receive a flower pot.

12. A flower merchandising display according to claim 11 wherein a second aperture is formed in the lower portion of said second container and is adapted to allow said gas to escape upwardly therethrough.

13. A flower merchandising display according to claim 8 wherein at least one aperture is formed in said elongated element and is spaced upwardly from the upper level of said liquid.

14. A flower merchandising display according to claim 1 wherein means to elevate said liquid comprises cooling means and wherein said liquid is cooled to approximately 2° C.

15. A flower merchandising display according to claim 1 wherein ice is disposed in a container and wherein said container is disposed substantially adjacent the upper end of said enveloping means.

* * * * *